US008510995B2

(12) United States Patent
Fulton et al.

(10) Patent No.: US 8,510,995 B2
(45) Date of Patent: Aug. 20, 2013

(54) LATCH JAMB SECURITY PLATE FOR DOORJAMB

(75) Inventors: Daniel Fulton, Charlotte, NC (US); Gary Fagan, Huntersville, NC (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 13/232,353

(22) Filed: Sep. 14, 2011

(65) Prior Publication Data

US 2012/0060423 A1 Mar. 15, 2012

Related U.S. Application Data

(60) Provisional application No. 61/382,566, filed on Sep. 14, 2010.

(51) Int. Cl.
*E05B 15/02* (2006.01)

(52) U.S. Cl.
USPC ..... 49/460; 70/416; 292/346; 292/DIG. 51; 292/DIG. 55

(58) Field of Classification Search
USPC ..... 49/460; 292/340, 341.11, 341.12, 292/346, DIG. 55, DIG. 51; 70/416, 417
See application file for complete search history.

(56) References Cited

U.S. PATENT DOCUMENTS

| | | | | | |
|---|---|---|---|---|---|
| 1,563,667 | A | * | 12/1925 | Smith | 292/341.18 |
| 3,007,732 | A | * | 11/1961 | Schlage | 292/341.12 |
| 3,287,055 | A | * | 11/1966 | Schlage | 292/341.12 |
| 3,338,008 | A | | 8/1967 | Sklar | |
| 3,442,543 | A | * | 5/1969 | Weyman | 292/340 |
| 3,606,429 | A | * | 9/1971 | Palmer | 292/340 |
| 3,918,207 | A | | 11/1975 | Aliotta | |
| 4,017,106 | A | * | 4/1977 | Salazar | 292/340 |
| 4,057,275 | A | | 11/1977 | La Beaud | |
| D283,299 | S | * | 4/1986 | Mazie | D8/343 |
| 4,684,160 | A | | 8/1987 | Nelson | |
| 4,865,370 | A | | 9/1989 | Francis | |
| 4,993,764 | A | | 2/1991 | Barker | |
| 5,003,727 | A | | 4/1991 | Watten | |
| 5,024,475 | A | | 6/1991 | Francis | |
| 5,094,489 | A | * | 3/1992 | Jones | 292/340 |
| 5,241,790 | A | | 9/1993 | Schimpf | |
| 5,474,347 | A | * | 12/1995 | Vigneault et al. | 292/340 |
| 5,581,948 | A | * | 12/1996 | Simonsen | 49/460 |
| 5,586,796 | A | | 12/1996 | Fraser | |
| 5,836,628 | A | * | 11/1998 | Beier | 292/346 |
| 5,934,024 | A | * | 8/1999 | Simpson | 49/462 |

(Continued)

FOREIGN PATENT DOCUMENTS

| | | | |
|---|---|---|---|
| CA | 2103500 | A1 | 1/1993 |
| DE | 19637452 | A1 | 8/1997 |

*Primary Examiner* — Jerry Redman
(74) *Attorney, Agent, or Firm* — Berenato & White, LLC

(57) ABSTRACT

A latch jamb security plate in combination with a doorjamb having a front side facing a door opening and a back side opposite the front side. The doorjamb is formed with a latch aperture therethrough for receiving a retractable door latch. The latch jamb security plate comprises a planar plate member fastened to the back side of the doorjamb, and a single latch tongue formed integrally with the planar plate member and extending therefrom into the latch aperture in the doorjamb. The planar plate member has an opening therethrough aligned with the latch aperture in the doorjamb. The opening in the planar plate member has a continuous edge. The latch tongue is configured to extend from only a portion of the edge of the opening in the planar plate member.

11 Claims, 4 Drawing Sheets

(56) References Cited

U.S. PATENT DOCUMENTS

| | | | | |
|---|---|---|---|---|
| D417,516 | S | 12/1999 | White | |
| 6,082,049 | A | 7/2000 | Hudson | |
| 6,834,897 | B1 * | 12/2004 | Walker | 292/340 |
| 6,901,706 | B2 * | 6/2005 | Olberding et al. | 49/460 |
| 7,000,959 | B2 * | 2/2006 | Sanders | 292/340 |
| 2003/0159361 | A1 | 8/2003 | Yeremian | |
| 2012/0228887 | A1 * | 9/2012 | McMullen | 292/340 |

* cited by examiner

LATCH JAMB SECURITY PLATE FOR DOORJAMB

CROSS-REFERENCE TO RELATED APPLICATION

This Application claims the benefit under 35 U.S.C. 119(e) of U.S. Provisional Application No. 61/382,566 filed Sep. 14, 2010 by Daniel Fulton and Gary Fagan, which is hereby incorporated herein by reference in its entirety and to which priority is claimed.

BACKGROUND OF THE INVENTION

1. Field of the Invention

The present invention relates generally to door security devices in general, and more particularly, to a latch jamb security plate for reinforcing a doorjamb.

2. Description of the Related Art

Conventionally, exterior doors are mounted to a doorjamb by at least a pair of hinges and are provided with a dead-bolt lock which is extended into a recess provided in the doorjamb to secure the door in a closed position. Doorjambs are typically made of wood and are fastened to the structure frame with nails or screws. Doorjambs typically extend around the top and two sides of a door opening and have an inwardly facing or front face with a stepped configuration such that edges of a closed door abut a step in the doorjamb. Hinges are fastened to the front face on one side of the doorjamb (the hinge side) and to one side of the door, typically by wood screws that are screwed into the doorjamb and door. It is well known that the weakest region of a door frame is the region where a bolt of the dead-bolt lock interacts with the doorjamb. The portion of the doorjamb that is provided for restraining the door bolt or latch is commonly composed of wood.

Numerous solutions to the door security problem including devices for reinforcing a doorjamb have been previously proposed, and many of these devices have achieved varying degrees of success. While known solutions to reinforce a doorjamb have proven to be acceptable for various applications, such devices are nevertheless susceptible to improvements that may enhance their performance and cost. With this in mind, a need exists to develop an improved latch jamb security plate for reinforcing a doorjamb that advance the art.

SUMMARY OF THE INVENTION

The present invention provides an improved latch jamb security plate in combination with a doorjamb having a front side facing a door opening and a back side opposite the front side. The doorjamb is formed with a latch aperture therethrough for receiving a retractable door latch. The latch jamb security plate comprises a planar plate member fastened to the back side of the doorjamb, and a single latch tongue formed integrally with the planar plate member and extending therefrom into the latch aperture in the doorjamb. The planar plate member has an opening therethrough aligned with the latch aperture in the doorjamb. The opening in the planar plate member has a continuous edge. The latch tongue is configured to extend from only a portion of the edge of the opening in the planar plate member.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS

Figure 1:
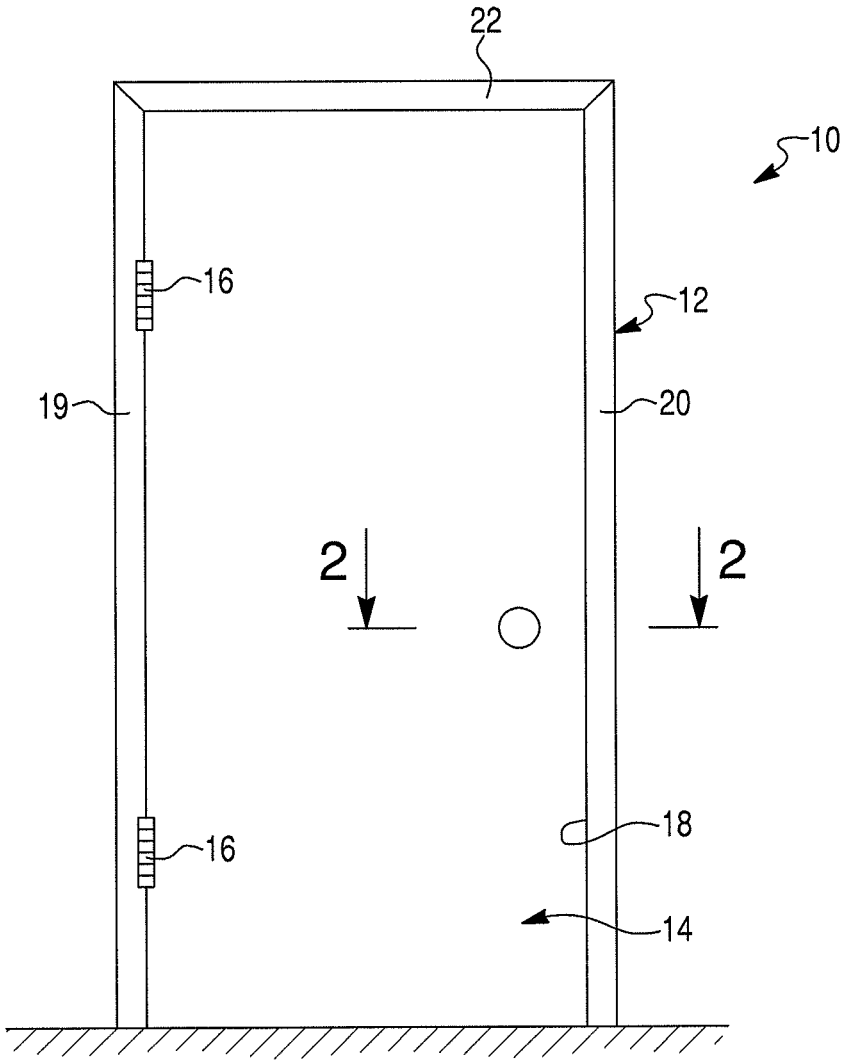
FIG. 1 is a perspective view of a door assembly having a doorjamb according to the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

FIG. 1 of the drawings illustrates a door assembly, generally denoted by reference numeral 10. The door assembly 10 includes a door frame 12 and a door 14 pivotally mounted on the door frame 12 through a door hinges 16. The door frame 12 defines a door opening 18 selectively closeable by the door 14. The door frame 12 conventionally includes a pair of upright or side doorjambs: a hinge side doorjamb 19 and a latch side doorjamb 20, and a horizontal or head doorjamb 22. According to the exemplary embodiment of the present invention, the side doorjambs 19 and 20 and the head doorjamb 22 have identical cross sectional shape. Therefore only the latch side doorjamb 20 will be described herein below in detail.

The doorjamb 20 is conventionally secured to a wall assembly 30 (shown in FIG. 2) that includes upright stud members 32 enclosed by an inner wall 36 and an outer wall 38. The doorjamb 20 is secured to the stud members 32 in a suitable manner, such as with a plurality of screws or nails (not shown).

Figure 2:
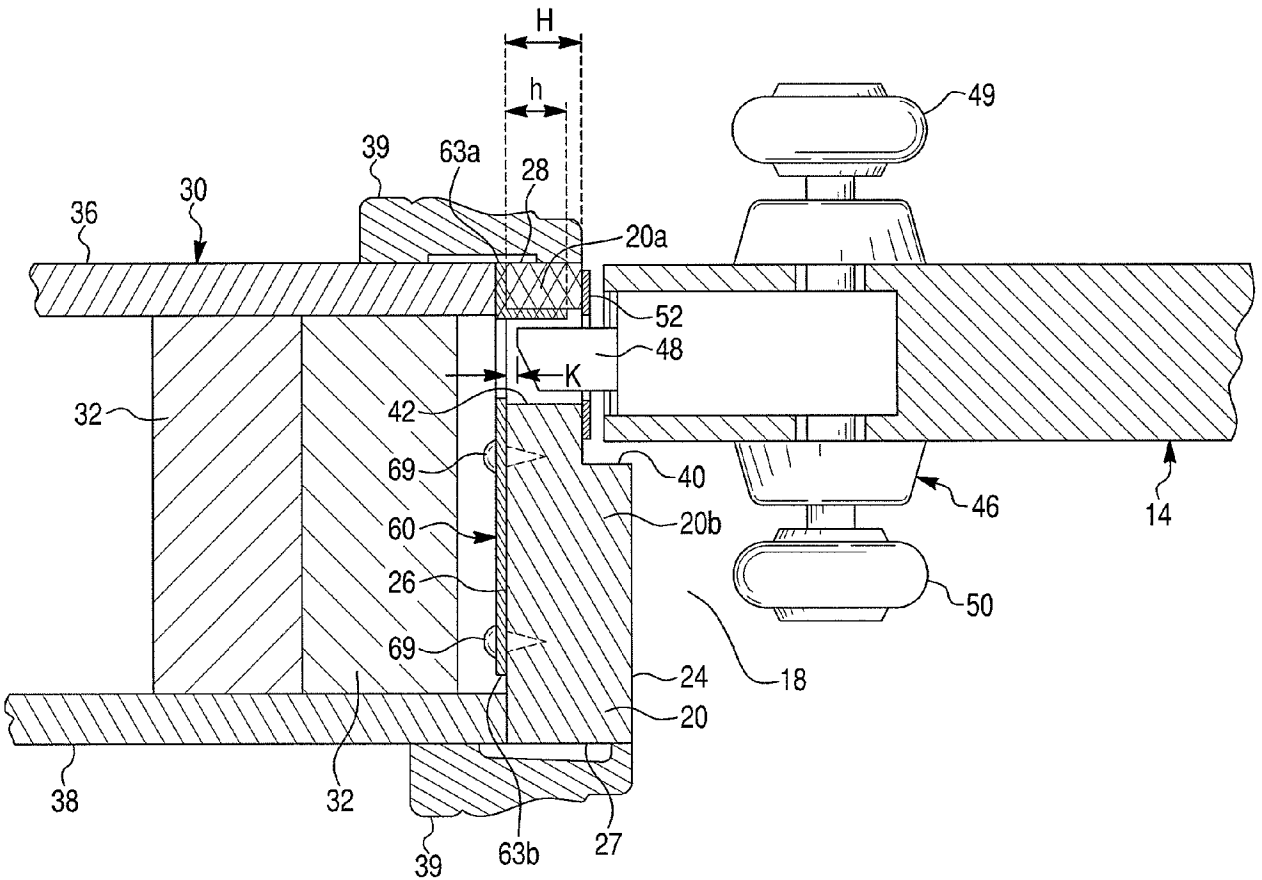
FIG. 2 is a horizontal cross-sectional view of the door assembly in accordance with an exemplary embodiment of the present invention taken along the lines 2-2 in FIG. 2.

Referring now to the drawing FIG. 2, the doorjamb 20 has a front side 24 facing the door opening 18 and a back side 26 opposite the front side 24 thereof. The doorjamb 20 also has an outer edge 27 and an inner edge 28. The front side 24 of the doorjamb 20 is provided with a stop member (or step) 40 against which the door 14 abuts when closed. The step 40 divides the doorjamb 20 to a thinner inner portion 20*a* adjacent to the inner wall 36 and defining the inner edge 28 of the doorjamb 20, and a thicker outer portion 20*b* adjacent to the outer wall 38 and defining the outer edge 27 of the doorjamb 20. The inner portion 20*a* of the doorjamb 20 has a thickness H and is formed with a latch aperture 42 extending therethrough. The outer and inner edges 27 and 28 of the doorjamb 20 and portions of the inner and outer walls 36 and 38 are covered with door moldings 39.

As further illustrated in FIGS. 1 and 2, the door 14 comprises a lock assembly 46. The lock assembly 46 conventionally includes a retractable door latch 48 operable by an inner knob 49 or an outer knob 50. As illustrated in detail in FIG. 2, when the door 14 is closed against the stop member 40, the retractable door latch 48 conventionally extends into the latch aperture 42 formed through the doorjamb 20 proximate to the inner edge 28 thereof to interlock the door 14 with the doorjamb 20. A striker plate 52 is secured to jamb 20 and is adapted to receive the door latch 48 of the lock assembly 46. According to the exemplary embodiment of the present invention, the door latch 48 does not extend through the whole thickness H of the doorjamb 20. As shown in FIG. 2, there is a space k between a distal end of the retractable door latch 48 and the back side 26 of the doorjamb 20 when the door 14 is closed and the retractable door latch 48 extends to an outermost position thereof. The thickness H of the doorjamb 20 is defined as a distance between the front side 24 and the back side 26 of the inner portion 20*a* of the doorjamb 20 which includes the latch aperture 42.

As illustrated in FIG. 2, a latch jamb security plate 60 is fastened to the back side 26 of the latch side doorjamb 20. The latch jamb security plate 60, illustrated in detail in FIGS. 3-6, is preferably made of steel. Plate 60 comprises a planar plate member 62 fastened to the back side 26 of the doorjamb 20, and a single latch tongue 66 formed integrally with the planar plate member 62 and extending therefrom into the latch aperture 42 in the doorjamb 20 (as shown in FIG. 2). It will be appreciated that the latch jamb security plate 60 is configured and mounted to the doorjamb 20 so that the door latch 48 of the lock assembly 46 engages the latch tongue 66 of the latch jamb security plate 60 if unauthorized person is trying to open the door 14 from the outside, thus preventing the opening of the door 14 and providing enhanced security.

The planar plate member 62 is substantially rectangular in shape, has two pairs of straight, substantially parallel, opposite outer edges 63*a*, 63*b* and 65*a*, 65*b*, and includes an opening 64 therethrough aligned with the latch aperture 42 in the doorjamb 20. As shown in FIG. 2, the edge 63*a* of the planar plate member 62 faces the inner wall 36, while the edge 63*b* faces the outer wall 38 of the wall assembly 30. According to the exemplary embodiment of the present invention, the opening 64 is rectangular, has a continuous edge including two straight opposite edges 64*a* and 64*b* substantially parallel to each other and to the straight edge 63*a* of the plate member 62, and is disposed asymmetrically relative to one pair of the opposite edges 63*a*, 63*b* thereof, specifically closer to the straight edge 63*a* of the planar plate member 62 adjacent to the inner edge 28 of the doorjamb 20.

Figure 3:
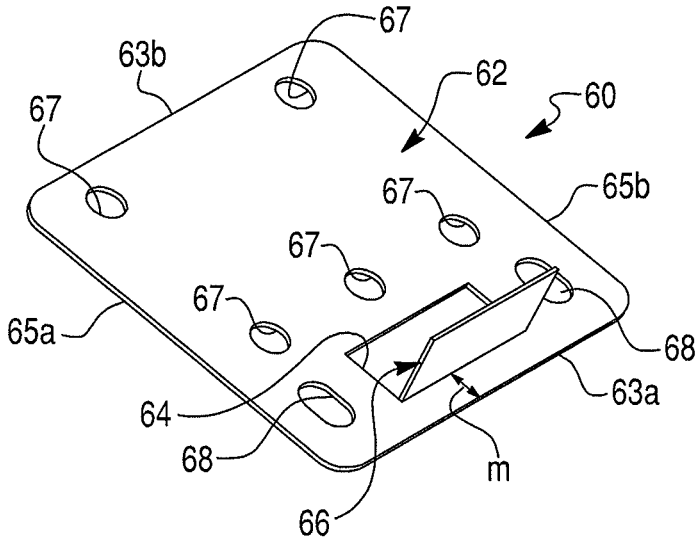
FIG. 3 is a perspective view of a latch jamb security plate in accordance with the exemplary embodiment of the present invention.
Figure 4:
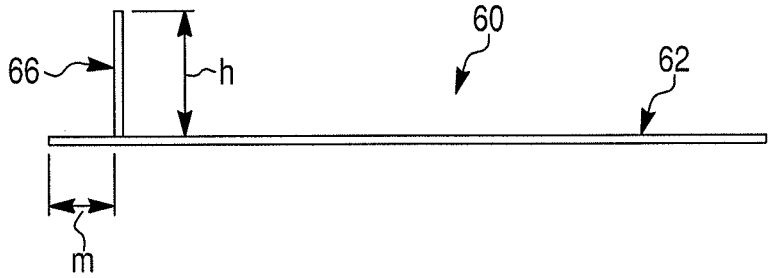
FIG. 4 is a side view of the latch jamb security plate in accordance with the exemplary embodiment of the present invention.
Figure 5:
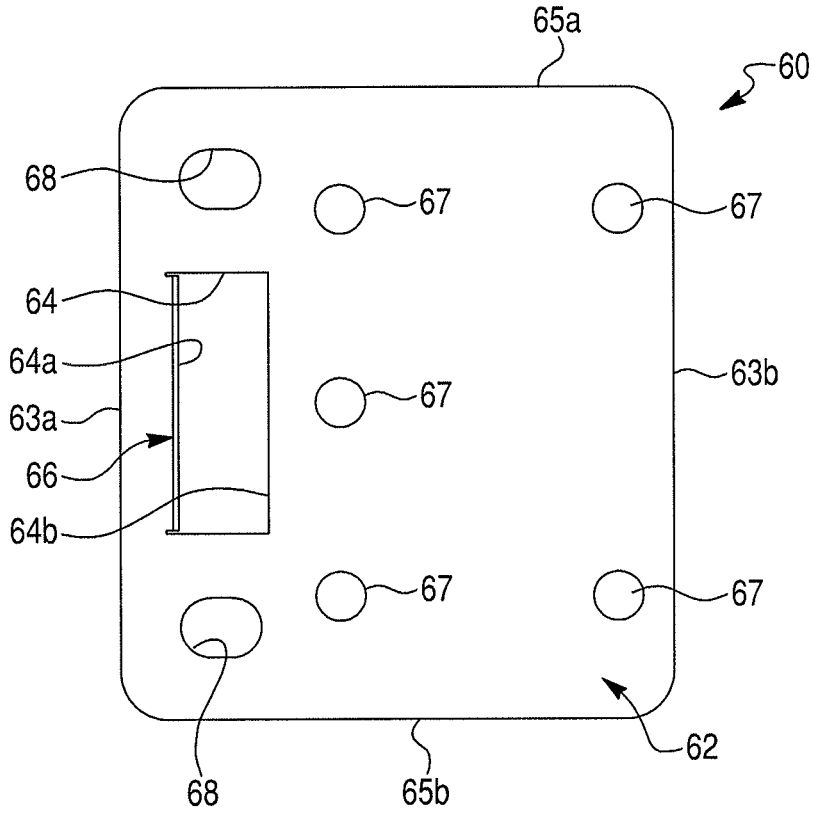
FIG. 5 is a top view of the latch jamb security plate in accordance with the exemplary embodiment of the present invention.
Figure 6:
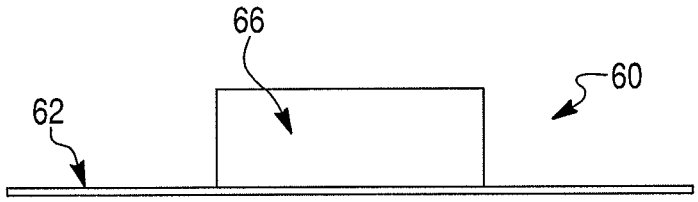
FIG. 6 is a rear view of the latch jamb security plate in accordance with the exemplary embodiment of the present invention.

The latch tongue 66 extends from only a portion of the continuous edge of the opening 64 in the planar plate member 62. Specifically, in the exemplary embodiment shown in FIGS. 2-6, the latch tongue 66 extends from the straight edge 64*a* of the rectangular opening 64 in the planar plate member 62 adjacent (closest) to the inner edge 28 of the doorjamb 20, thus to the inner wall 36 of the wall assembly 30. Thus, even if the jamb 20 is fractured or broken by an attempt to forcibly open the door 14, the latch tongue 60 will engage the door latch 48 and maintain the door 14 secure. Moreover, the latch tongue 66 extends from the planar plate member 62 so that the latch tongue 66 does not extend through the whole thickness H of the doorjamb 20. As illustrated in FIG. 2, a height h of the latch tongue 66 is less than the thickness H of the doorjamb 20 so that the latch tongue 66 is not visible when installed. Furthermore, the latch tongue 66 is disposed between the opposite edges 63*a* and 63*b* of the planar plate member 62, and is formed adjacent (closer) but spaced from the edge 63*a* of the planar plate member 62. As best shown in FIGS. 3-5, the latch tongue 66 is spaced from the straight edge 63*a* of the plate member 62 by a distance m. According to the exemplary embodiment of the present invention as shown in FIG. 2, the distance m is substantially equal to a thickness of the inner wall 36 of the wall assembly 30.

The planar plate member 62 has a plurality of circular holes 67 (shown in FIG. 3) receiving threaded fasteners 69 therethrough (as shown in FIG. 2) for fastening the latch jamb security plate 60 to the back side 26 of the doorjamb 20. The planar plate member 62 has a pair of elongated, generally oval holes or slots 68 (shown in FIG. 3) for receiving threaded fasteners therethrough for allowing adjustment of the latch jamb security plate 60 relative to the latch aperture 42 in the doorjamb 20, and specifically, the alignment of the latch tongue 66 of the latch jamb security plate 60 with the latch aperture 42 in the doorjamb 20.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A latch jamb security plate in combination with a doorjamb, said doorjamb having a front side facing a door opening and a back side opposite said front side, said doorjamb having a latch aperture therethrough for receiving a retractable door latch, said latch jamb security plate comprising:

a planar plate member fastened to said back side of said doorjamb; and a single latch tongue formed integrally with said planar plate member and extending therefrom into said latch aperture in said doorjamb toward retractable said door latch;

said planar plate member having a rectangular opening therethrough aligned with said latch aperture in said doorjamb, said opening in said planar plate member having a continuous inner edge extending around three sides of said rectangular opening;

said latch tongue being bent at an angle with respect to said planar plate member to form a fourth side of said rectangular opening, said latch tongue being parallel to and offset from a peripheral edge of said planar plate member by a predetermined distance (m), wherein a height (h) of said latch tongue is less than a whole thickness (H) of said doorjamb, and wherein said height (h) of said latch tongue is greater than said predetermined distance (m) between said latch tongue and said peripheral edge.

2. The latch jamb security plate as defined in claim 1, wherein said planar plate member has an elongated, generally oval slot for receiving a threaded fastener therethrough for allowing adjustment of said latch jamb security plate relative to said latch aperture in said doorjamb.

3. The latch jamb security plate as defined in claim 2, wherein said planar plate member has a plurality of circular holes receiving threaded fasteners therethrough for fastening said latch jamb security plate said back side of said doorjamb.

4. The latch jamb security plate as defined in claim 1, wherein said front side of said doorjamb is provided with a stop member against which said door abuts when closed.

5. The latch jamb security plate as defined in claim 4, wherein said stop member divides said doorjamb to an inner portion defining an inner edge of said doorjamb and an outer portion defining an outer edge thereof such that inner portion is thinner than said outer portion; and wherein said latch aperture is formed in said inner portion of said doorjamb.

6. The latch jamb security plate as defined in claim 5, wherein said planar plate member is substantially rectangular in shape and has two pairs of straight, substantially parallel, opposite outer edges; and wherein said opening in said planar plate member is disposed adjacent to said inner edge of said doorjamb.

7. The latch jamb security plate as defined in claim 6, wherein said opening in said planar plate member is substantially rectangular in shape and said continuous edge includes two pairs of straight opposite edges substantially parallel such that said latch tongue extends from one of said straight edges of said rectangular opening; and wherein each of said pairs of straight edges of said rectangular opening is parallel to one of said pairs of straight outer edges of said planar plate member.

8. The latch jamb security plate as defined in claim 7, wherein said latch tongue extends from one of said straight edges of said rectangular opening in said planar plate member closest to said inner edge of said doorjamb.

9. The latch jamb security plate as defined in claim 8, wherein said latch tongue does not extend through a whole thickness of inner portion of said doorjamb.

10. The latch jamb security plate as defined in claim 9, wherein said door latch does not extend through the whole thickness of said doorjamb.

11. The latch jamb security plate as defined in claim 8, wherein said latch tongue is spaced from said straight edges of said planar plate member by said predetermined distance.

* * * * *